US008141861B2

(12) United States Patent
Kamiya

(10) Patent No.: US 8,141,861 B2
(45) Date of Patent: Mar. 27, 2012

(54) SHEET PROCESSING APPARATUS AND IMAGE FORMING APPARATUS

(75) Inventor: Daisaku Kamiya, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 223 days.

(21) Appl. No.: 12/498,034

(22) Filed: Jul. 6, 2009

(65) Prior Publication Data

US 2010/0007072 A1 Jan. 14, 2010

(30) Foreign Application Priority Data

Jul. 11, 2008 (JP) ..... 2008-181251
Jun. 26, 2009 (JP) ..... 2009-152305

(51) Int. Cl.
*B65H 37/04* (2006.01)

(52) U.S. Cl. ..... 270/37; 270/58.07; 270/58.08; 270/58.09; 270/58.11; 270/58.12; 270/58.17

(58) Field of Classification Search ..... 270/37, 270/58.07, 58.08, 58.09, 58.11, 58.12, 58.17
See application file for complete search history.

(56) References Cited

U.S. PATENT DOCUMENTS 6,217,016 B1 * 4/2001 Honmochi et al. ..... 270/37
6,607,188 B2 * 8/2003 Sato et al. ..... 270/58.09
6,647,243 B2 11/2003 Sato et al. ..... 399/407
6,671,491 B1 12/2003 Yamanaka et al. ..... 399/407
6,845,228 B2 1/2005 Suzuki et al. ..... 399/407
7,007,948 B2 3/2006 Kamiya et al. ..... 271/221
7,050,752 B2 5/2006 Sato et al. ..... 399/405
7,120,383 B2 10/2006 Sato et al. ..... 399/407
7,455,284 B2 * 11/2008 Kotani ..... 270/58.04
7,597,311 B2 * 10/2009 Kawata et al. ..... 270/37
2007/0060459 A1 3/2007 Hayashi ..... 493/434
2007/0126165 A1 * 6/2007 Kawata et al. ..... 270/37
2007/0170634 A1 * 7/2007 Kotani ..... 270/58.04
2008/0214377 A1 9/2008 Kamiya ..... 493/421
2009/0127764 A1 5/2009 Kamiya ..... 270/58.07
2009/0134563 A1 5/2009 Watanabe et al. ..... 270/45

* cited by examiner

*Primary Examiner* — Leslie A Nicholson, III
(74) *Attorney, Agent, or Firm* — Fitzpatrick, Cella, Harper & Scinto

(57) ABSTRACT

The present invention provides a sheet processing apparatus including: a conveying portion which conveys a sheet; a stacking portion which stacks the sheet conveyed by the conveying portion; a first processing unit which performs a process to the sheet at a first process position on the stacking portion; a second processing unit which performs a process to the sheet at a second process position on the stacking portion, the second process position being at the downstream side in the conveying direction of the first process position; and a controlling portion which performs positioning of the sheet at the first process position when the first processing unit performs the process to the sheet and positioning of the sheet at the second process position when the second processing unit performs the process to the sheet which is passed through the first process position without being positioned.

13 Claims, 13 Drawing Sheets

SHEET PROCESSING APPARATUS AND IMAGE FORMING APPARATUS

BACKGROUND OF THE INVENTION

1. Field of the Invention

The present invention relates to a sheet processing apparatus which produces a sheet bundle of a folded booklet shape and an image forming apparatus which includes the sheet processing apparatus.

2. Description of the Related Art

In related art, there has been an image forming apparatus for forming an image on a sheet with a sheet processing apparatus which produces a booklet by binding and folding the bundled sheets on which images are formed by the apparatus main body, as disclosed in US20070060459, for example.

With such an image processing apparatus of the related art, the sheets conveyed to a stack tray are aligned after being received sequentially at a binding position where the center parts of the sheets are to be bound. Then, the sheet bundle is conveyed to a folding position which is located downstream the binding position to match the center part with a fold-line to be folded after or without being bound at the center parts of the sheets. Then, the sheet bundle is thrust at the center part by a thrusting member so as to be thrust into a nip of a pair of folding rollers. Accordingly, the sheet bundle is folded while being conveyed by the pair of folding rollers.

The top part of the folded portion is processes so that the fold-line is reinforced by a pair of press rollers which is different from the pair of folding rollers being moved along the fold-line of the sheet (in the direction orthogonal to the sheet conveying direction). Then, the sheet bundle subjected to the folding process is conveyed and discharged to a folded bundle discharging tray. In this manner, a booklet can be obtained as a product.

In the sheet processing apparatus in the related art, as described above, the stacked sheets or the stacked sheet bundle have been conveyed to the folding position at the downstream side of the conveying direction after being aligned at the binding position even when performing the folding process without the binding process (hereinafter, called non-binding folding). Therefore, there is a possibility that folding accuracy is declined by shifting of the sheets during the sheet bundle is conveyed. Further, since the sheet bundle conveyance takes time, productivity is decreased.

The present invention provides a sheet processing apparatus which has high folding accuracy and high productivity while suppressing poor conveyance stacking.

SUMMARY OF THE INVENTION

According to an aspect of the present invention, there is provided a sheet processing apparatus including: a conveying portion which conveys a sheet; a stacking portion on which the sheet conveyed by the conveying portion is stacked; a first processing unit which performs a process to the sheet at a first process position on the stacking portion; a second processing unit which performs a process to the sheet at a second process position on the stacking portion, the second process position being at the downstream side in the conveying direction of the first process position; and a controlling portion which performs positioning of the sheet at the first process position when the first processing unit performs the process to the sheet and positioning of the sheet at the second process position when the second processing unit performs the process to the sheet which is passed through the first process position without being positioned.

According to the present invention, folding accuracy and productivity can be improved while suppressing poor conveyance stacking.

Further features of the present invention will become apparent from the following description of exemplary embodiments with reference to the attached drawings.

DESCRIPTION OF THE EMBODIMENTS

First Embodiment

The sheet processing apparatus of the first embodiment according to the present invention is described with reference to the drawings.

(Image Forming Apparatus)

Figure 1:
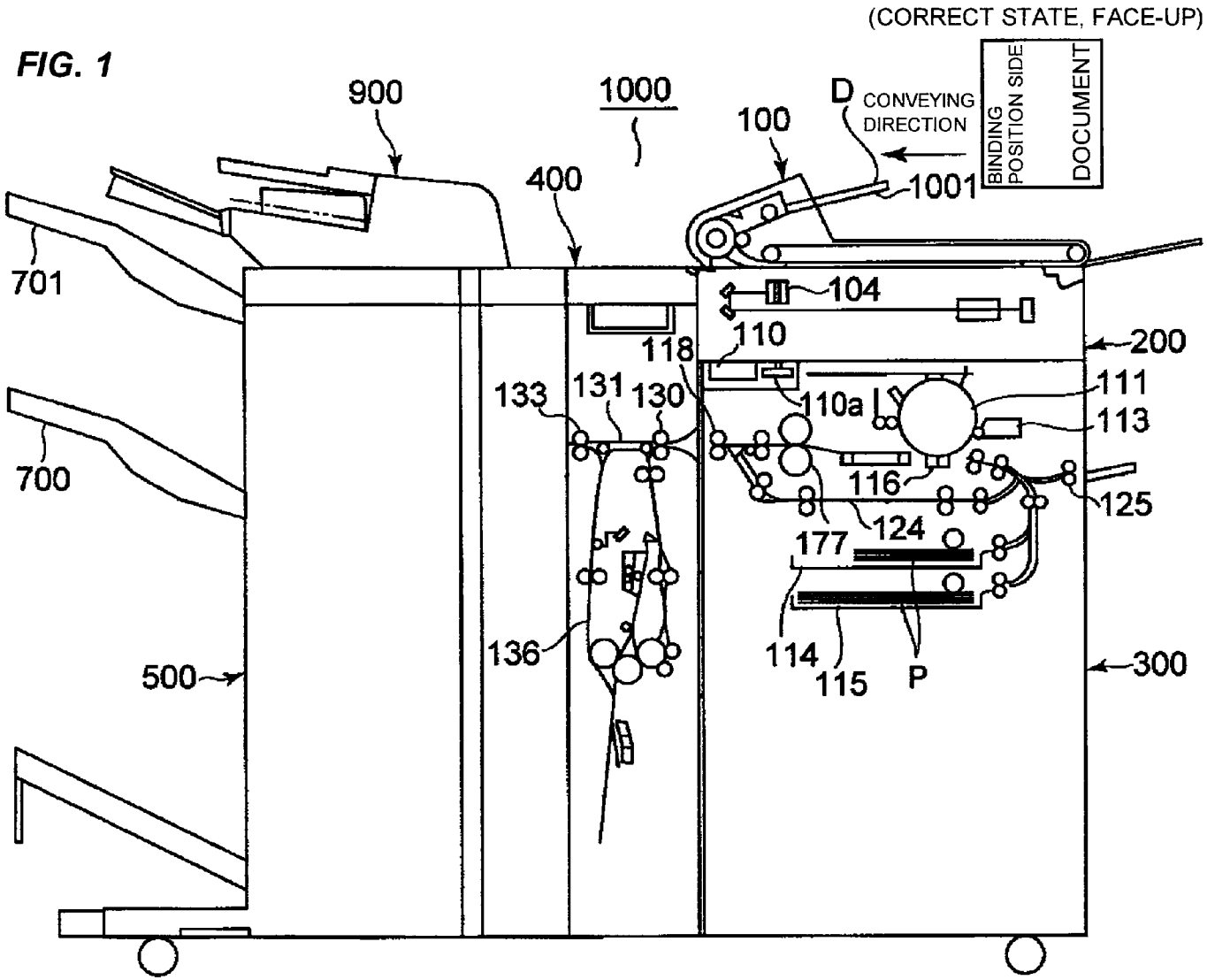
FIG. 1 is a schematic view of an image forming apparatus according to a first embodiment.

FIG. 1 is a sectional view of a copying machine 1000 serving as an image forming apparatus which has a sheet processing apparatus according to the present embodiment. As illustrated in FIG. 1, the copying machine 1000 which is an example of the image forming apparatus includes a document feeding portion 100, an image reader portion 200, a printer portion 300, a folding process portion 400, a finisher 500 serving as the sheet processing apparatus and an inserter 900. The folding process portion 400 and the inserter 900 can be provided optionally. The finisher 500 has a saddle stitch binding portion 800 which is described later.

A scanner unit 104 reads an image of a document D which is set at a tray 1001 of the document feeding portion 100. The image data of the read document D is conveyed to an exposure controlling portion 110 after being subjected to a predetermined image process. The exposure controlling portion 110 outputs a laser beam corresponding to the image signal. The laser beam is irradiated on a photosensitive drum 111 while being scanned by a polygon mirror 110*a*. An electrostatic latent image corresponding to the scanned laser beam is formed on the photosensitive drum 111.

The electrostatic latent image formed on the photosensitive drum 111 is developed by a development device 113 so as to be visualized as a toner image. On the other hand, a sheet P is conveyed to a transfer portion 116 from any one of cassettes 114, 115, a manual feeding portion 125 and a duplex conveying path 124. Then, the visualized toner image is transferred onto the sheet P at the transfer portion 116. The toner image transferred onto the sheet P is fixed at a fixing portion 177. The photosensitive drum 111 and the development device 113 configure an image forming portion. The sheet P is discharged to the folding process portion 400 by a discharging roller 118 after passing through the fixing portion 177.

(Folding Process Portion 400)

Next, the configuration of the folding process portion 400 is described. In FIG. 1, the sheet P conveyed to the folding process portion 400 is guided to a pair of conveying rollers 130. The pair of conveying rollers 130 guide the conveyed sheet P into a fold path 136 or the finisher 500. The sheet P which is Z-folded is guided to conveying paths 145, 131, and discharged to the finisher 500 by a pair of discharging rollers 133.

(Finisher 500)

Figure 2:
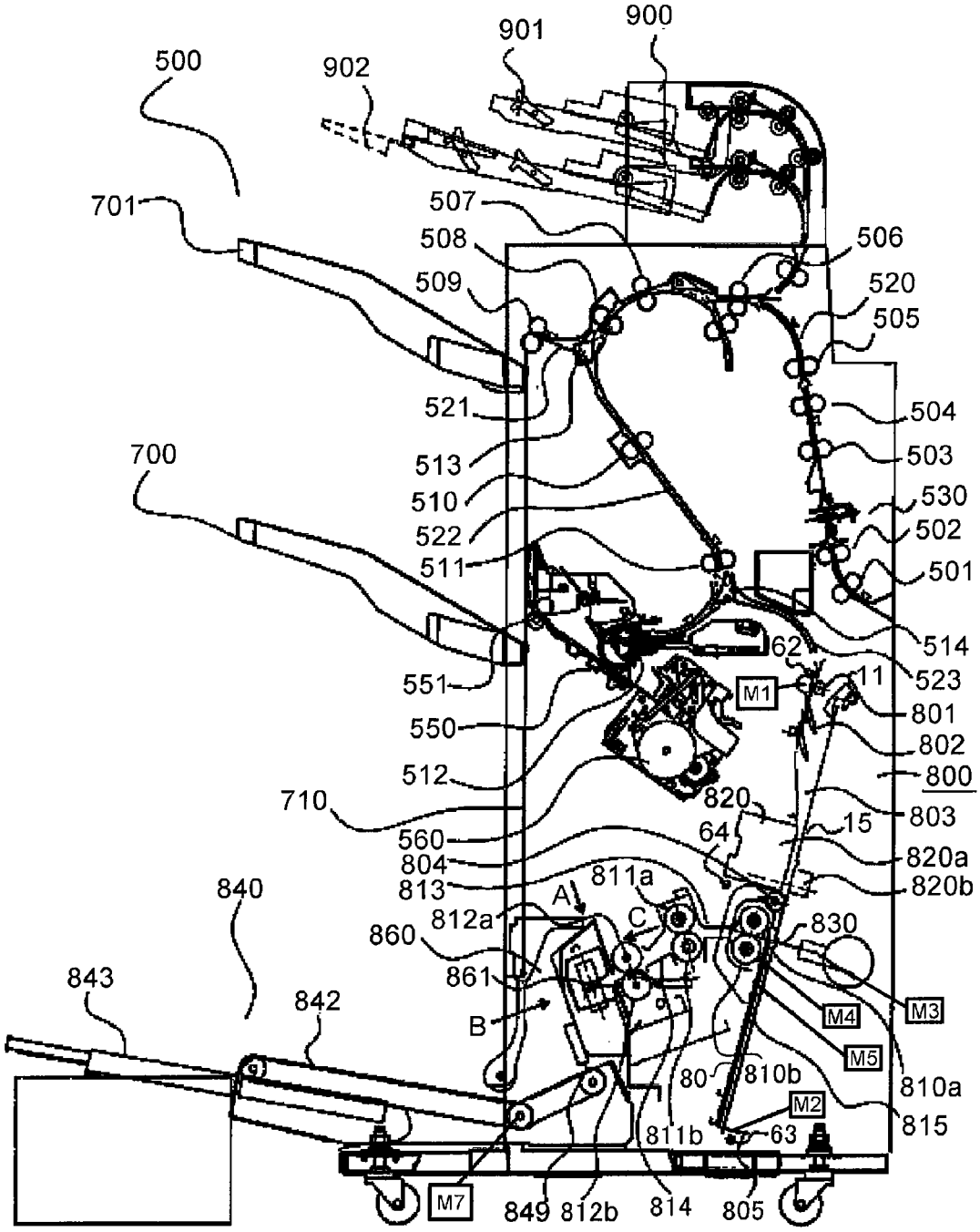
FIG. 2 is a schematic view of a sheet processing apparatus.

The configuration of the finisher 500 is described with reference to FIG. 2. FIG. 2 is a sectional view which illustrates the inner configuration of the finisher 500. The finisher 500 aligns the plurality of sheets P which are conveyed from the printer portion 300 via the folding process portion 400. Then, the finisher 500 selectively performs sheet processes such as a bundling process to bundle into one sheet bundle, a stapling process (i.e., a binding process) to staple the sheet bundle at the trailing end side, a sorting process, and a non-sorting process.

As illustrated in FIG. 2, the finisher 500 has a conveying path 520 for introducing the sheet P conveyed via the folding process portion 400 of FIG. 1 into the finisher 500. The conveying path 520 is provided with pairs of conveying rollers 502 to 508 in the sheet conveying direction in the order from a pair of entrance rollers 501 toward the downstream side.

A punch unit 530 is provided between the pair of conveying rollers 502 and the pair of conveying rollers 503. The punch unit 530 operates as needed so as to punch the conveyed sheet P (i.e., performs a punch process) at the trailing end part thereof.

A switching member 513 provided at the end part of the conveying path 520 switches the path of the downstream side between an upper discharge path 521 and a lower discharge path 522. The upper discharge path 521 guides the sheet P to a sample tray 701 with an upper discharging roller 509. On the other hand, the pairs of conveying rollers 510, 511, 512 are provided at the lower discharge path 522. The pairs of conveying rollers 510, 511, 512 discharge the sheet P to a process tray 550.

Figure 6:
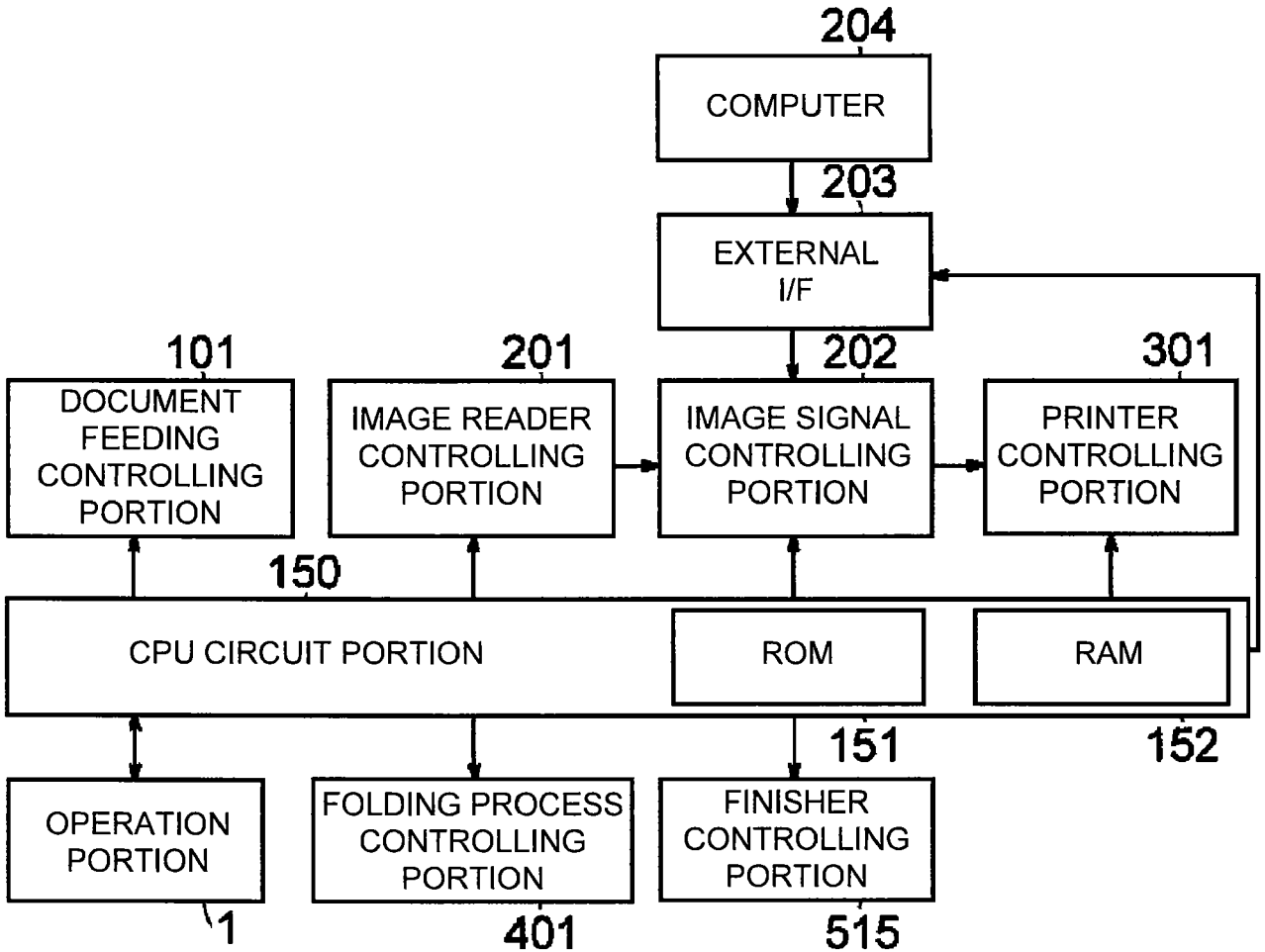
FIG. 6 is a control block diagram of a copying machine.

The sheets P discharged to the process tray 550 are stacked in a bundle shape while being sequentially aligned and are subjected to the sorting process or the stapling process in accordance with settings of an operating portion 1 in FIG. 6. The processed sheet bundle is discharged by a pair of bundle discharging rollers 551 selectively to a stack tray 700 or the sample tray 701.

The stapling process is performed by a stapler 560. The stapler 560 moves in the width direction (i.e., the direction crossing to the conveying direction) of the sheet and binds the sheet bundle at an arbitrary position. The stack tray 700 and the sample tray 701 are lifted and lowered along a main body 500A of the finisher 500. The sample tray 701 at the upper side receives the sheets P from the upper discharge path 521 and the process tray 550. The stack tray 700 at the lower side receives the sheets P from the process tray 550. Accordingly, large amount of sheets are stacked onto the stack tray 700 and the sample tray 701. The stacked sheets are aligned by being received at the trailing ends thereof by a trailing end guide 710 which extends in the vertical direction.

(Saddle Stitch Binding Portion 800)

Next, the configuration of the saddle stitch binding portion 800 which is included in the finisher 500 is described. Here, in the following description, a "folding process" denotes a process to fold the sheet bundle with a pair of folding rollers 810 and a thrusting member 830 which configure a folding unit (i.e., a second processing unit). Further, a "creasing process" denotes a process to crease the sheet bundle subjected to the folding process with a pair of press rollers 861.

A switching member 514 arranged at some midpoint of the lower discharge path 522 switches the conveying direction of the sheet P to the right side so as to guide to a saddle discharge path 523 which guides to the saddle stitch binding portion 800.

A pair of saddle entrance rollers (i.e., a conveying portion) 801, a storing guide (i.e., a stacking portion) 803, a conveying roller 804 and a positioning member (i.e., a receiving member) 805 are arranged in order from the entrance of the saddle stitch binding portion 800. The storing guide 803 stores the sheets P while being configured to be approximately vertical (75° in the drawings) in order to downsize the finisher 500.

The pair of saddle entrance rollers 801 and the conveying roller 804 are rotated by a conveying motor M1. The conveying roller 804 is supported by a driving source (not illustrated) to be capable of contacting to and separating from the sheet. Accordingly, the conveying roller 804 can perform the operation of contacting and separating at predetermined timing. Further, a stapler 820 serving as a first processing unit is provided at some midpoint of the storing guide 803 as being opposed to sandwich the storing guide 803. The stapler 820 includes a driver 820*a* which projects a staple and an anvil 820*b* which folds the projected staple. The stapler 820 serving as the first processing unit performs the binding process serving as a first process to the sheet bundle at the binding position (i.e., a first process position).

Figure 3:
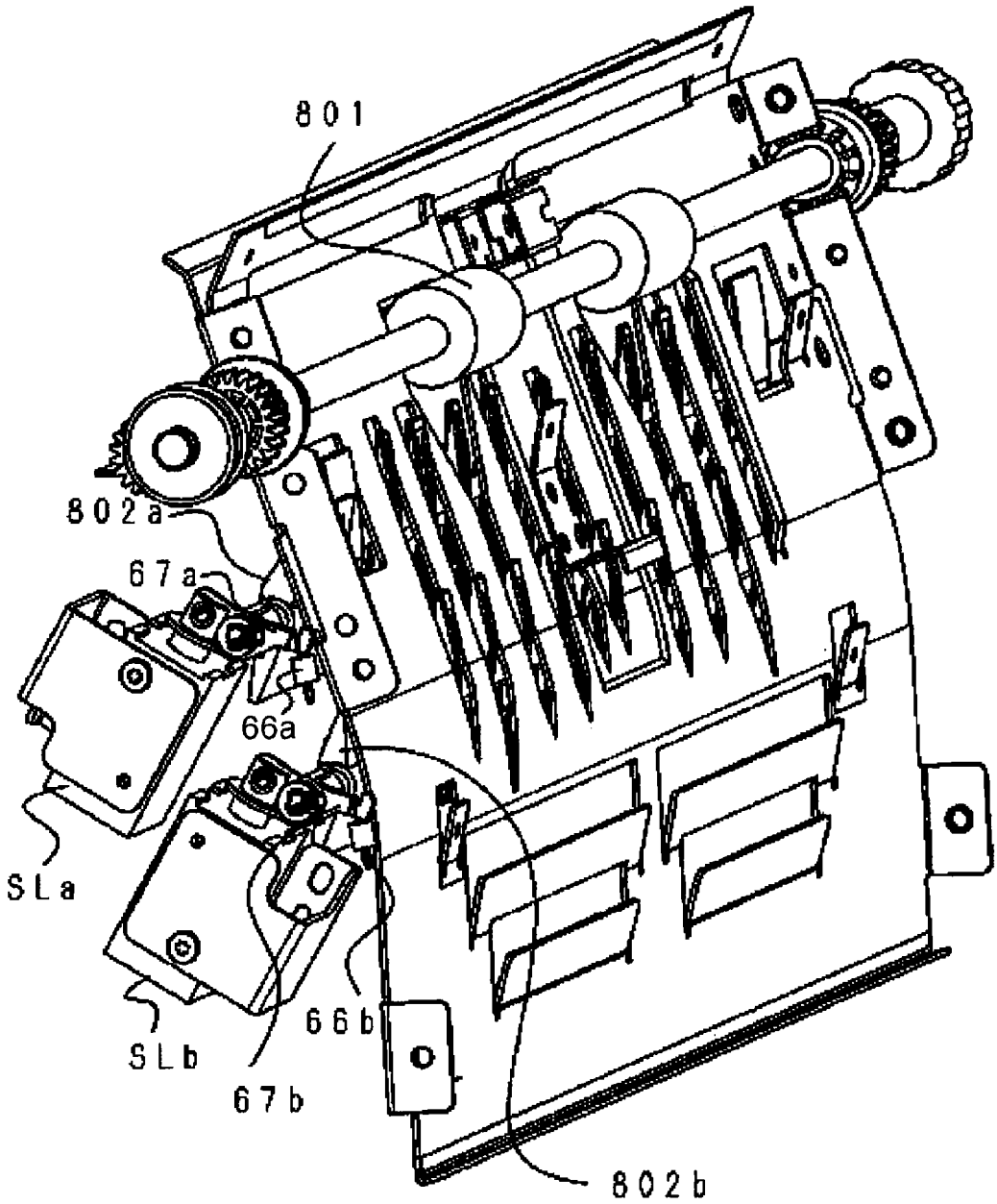
FIG. 3 is a perspective view which illustrates the configuration of a vicinity of a guiding member.

A first sorting member (i.e., a guiding member) 802*a* and a second sorting member (i.e., a guiding member) 802*b* which are operated by solenoids SLa, SLb in accordance with the sheet size (i.e., the length in the conveying direction) stored in the storing guide 803 are illustrated in FIG. 3. The sorting members 802 are supported movably (rotatably) at the downstream side in the conveying direction of the pair of saddle entrance rollers 801 as one end being urged by a spring 66*a*, 66*b* respectively. A guide path to the storing guide 803 can be switched by the positions of the sorting members 802. The guide path is switched by moving the sorting members 802 in accordance with the process position. The solenoids SLa, SLb, the first sorting member 802*a* and the second sorting member 802*b* configure a sorting portion.

Figure 5A:
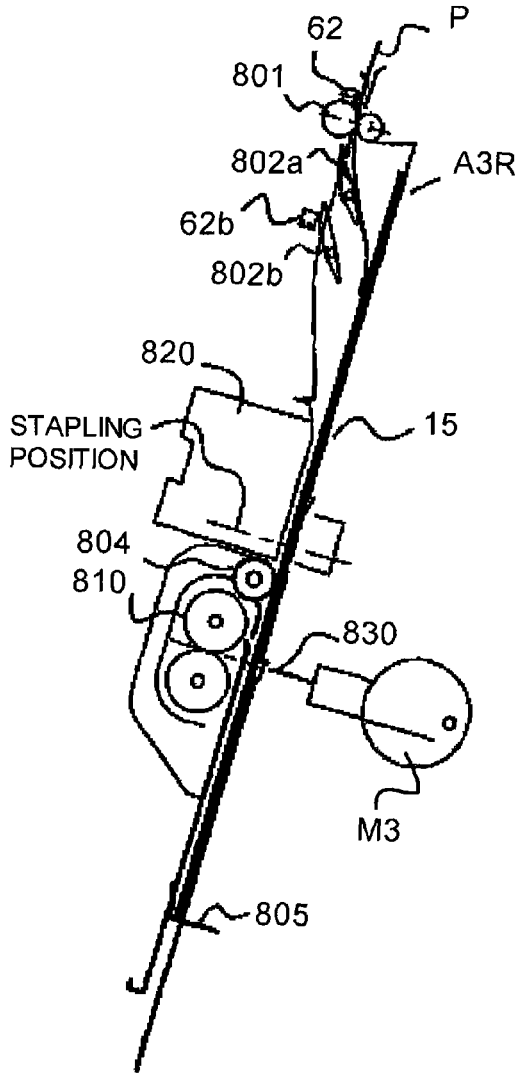
FIG. 5A and FIG. 5B are views which illustrate sheet conveyance operation.
Figure 5B:
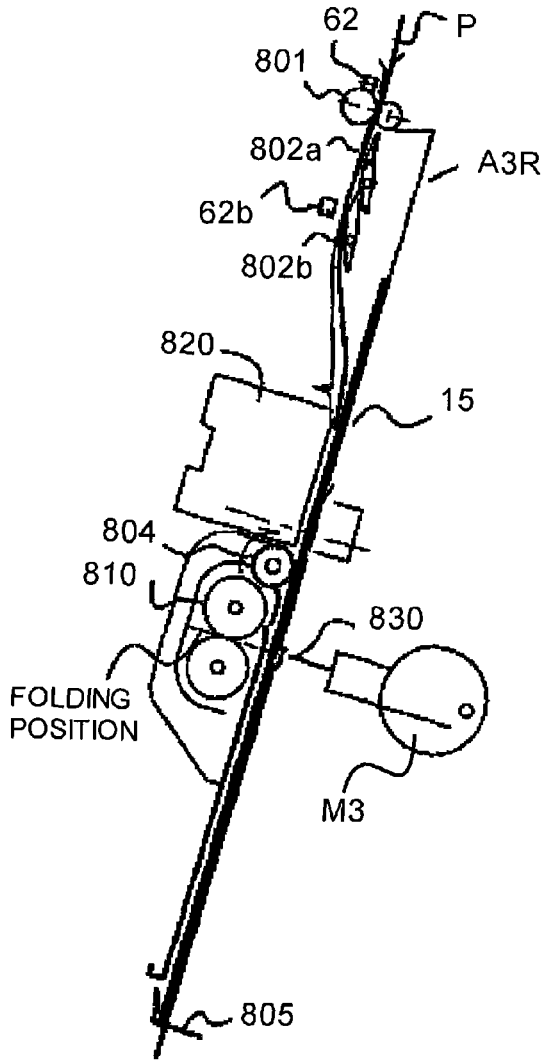

In the state that the solenoids SLa, SLb are not powered, the sorting members 802 are rotated so that one end thereof projects from a guide plate so as to guide the top end of the sheet P to be inserted in the direction to a stack tray 15, as illustrated in FIG. 5A. In the state that the solenoids SLa, SLb are powered, the sorting members 802 are rotated to follow the guide plate so that the top end of the sheet P to be inserted is guided along the guide plate, as illustrated in FIG. 5B. Further, these rotations are performed not to cause interference between the trailing end of the stacked sheet P and the top end of the sheet P to be inserted during the aligning at the binding position or the folding position provided the sheet size is a predetermined size.

Figure 4:
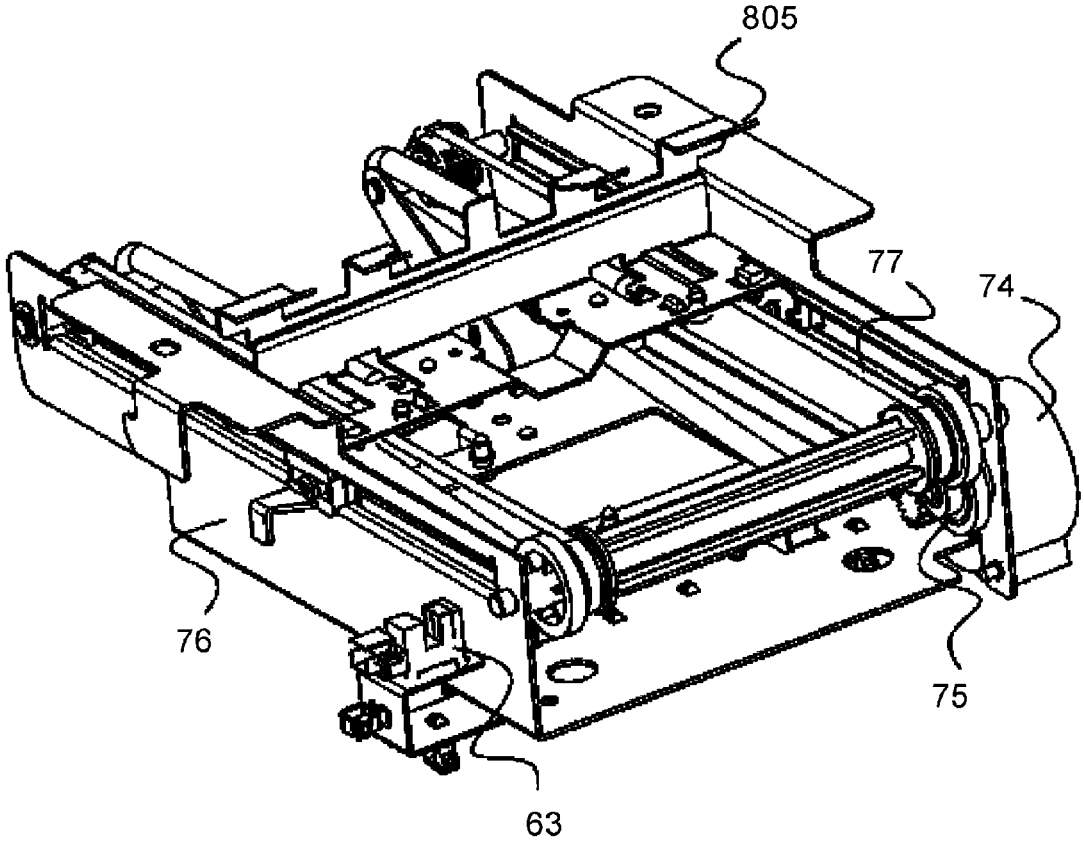
FIG. 4 is a perspective view which illustrates the configuration of a vicinity of a receiving member.

FIG. 4 is a structural view which illustrates the positioning member 805. As illustrated in FIG. 5A and FIG. 5B, the positioning member 805 is configured to be movable in the conveying direction along the stack tray 15. Then, the positioning member 805 receives the top end in the conveying direction of the sheet P conveyed by the storing guide 803 so as to define the stack position.

Specifically, the positioning member 805 is supported by a support frame 76 being free to slide, as illustrated in FIG. 4. The positioning member 805 is fixedly provided at a part thereof to a timing belt 77 and is moved in the direction along the stack tray 15 by rotation operation of a drive motor 74 (M2). The drive motor 74 (M2) and a drive gear 75 are provided to the support frame 76. The timing belt 77 transmits the driving force from the drive motor 74 (M2) and the drive gear 75.

As basic operation of the positioning member 805, the positioning member 805 can adjust the position by being lifted and lowered to receive the top end (i.e., the downstream end) of the sheet so that the center part of the sheet in the conveying direction is located at the binding position of the stapler 820 when the sheet is conveyed in the state that a saddle stitch binding process is specified. The positioning member 805 is lifted and lowered by the drive motor 74 (M2) and is stopped at a position in accordance with the sheet size (i.e., the length in the conveying direction). In the description of the present embodiment, the positioning member 805 is configured to receive the downstream end of the sheet in the conveying direction. However, the positioning member 805 may be configured to receive the upstream end of the sheet in the conveying direction depending on the sheet conveying direction to the storing guide 803 as switch-back conveyance, for example. In short, the present invention is applicable to the configuration that one end of the sheet in the conveying direction is received by the positioning member 805.

As illustrated in FIG. 2 and FIG. 5, the pair of folding rollers 810*a*, 810*b* are provided to the downstream side of the stapler 820 as being side-by-side. The thrusting member 830 is provided at a position opposite to the pair of folding rollers 810*a*, 810*b*. The pair of folding rollers 810*a*, 810*b* and the thrusting member 830 configure the folding portion serving as the second processing unit. The pair of folding rollers 810*a*, 810*b* and the thrusting member 830 serving as the second processing unit perform the folding process serving as a second process to the sheet bundle at the folding position (i.e., a second process position) where the process is performed. In the description of the present embodiment, the first process position and the second process position are configured to be located along the sheet conveying direction. However, the first process position and the second process position may be located along the direction crossing to the conveying direction, for example.

The thrusting member 830 having a home position at a position retracting from the storing guide 803 is capable of being thrust by the motor M3. When the sheet bundle is stored in the storing guide 803, the thrusting member 830 thrusts toward the sheet bundle and pushes the sheet bundle into a nip between the pair of folding rollers 810*a*, 810*b*. Then, the thrusting member 830 returns to the home position again. A force F11 which is sufficient for the folding process to fold the sheet bundle is applied between the pair of folding rollers 810 by a spring (not illustrated).

The sheet bundle folded by the pair of folding rollers 810 is discharged onto a folded bundle discharging tray 840 via a pair of first fold conveying rollers 811*a*, 811*b* and a pair of second fold conveying rollers 812*a*, 812*b*.

Forces F12, F13 which are sufficient to convey and stop the folded sheet bundle are applied as well between the pair of first fold conveying rollers 811*a*, 811*b* and between the pair of second fold conveying rollers 812*a*, 812*b*.

A conveying guide 813 guides the sheet bundle between the pair of folding rollers 810 and the pair of first fold conveying rollers 811. A conveying guide 814 guides the sheet bundle between the pair of first fold conveying rollers 811 and the pair of second fold conveying rollers 812. Here, the pair of folding rollers 810, the pair of first fold conveying rollers 811 and the pair of second fold conveying rollers 812 are rotated at a constant speed by the single motor M4 (see FIG. 2) while sandwiching the saddle folded sheet bundle from both surfaces.

The sheet bundle which is specified to the saddle stitch binding is bound at the binding position by the stapler 820. Then, the sheet bundle is lowered by a predetermined distance from the position for the stapling process by the positioning member 805 so that the binding position of the sheet bundle is matched with the nip position (hereinafter, called the folding position) of the pair of folding rollers 810. Subsequently, the folding process is performed. As a result, the sheet bundle is folded at the position subjected to the stapling process (i.e., the bound position) as the center.

An alignment plate 815 performs aligning in the width direction of the sheet P which is stored in the storing guide 803. The alignment plate 815 moves the sheet P in the sandwiching direction with a motor M5 (see FIG. 2) so as to perform positioning (i.e., aligning) in the sheet width direction.

A fold-line press unit 860 is provided serving as a fold portion processing unit at the downstream of the pair of second fold conveying rollers 812. The fold-line press unit 860 has a press holder 862 which supports a pair of press rollers 861. The fold-line is reinforced by moving the press holder 862 in the fold-line direction in the state that the folded part is nipped by the pair of press rollers 861. A first conveying belt 849 is arranged directly below the fold-line press unit 860. The sheet bundle is conveyed to a second conveying belt 842 from the first conveying belt 849, and then, stacked onto a discharging tray 843 from the second conveying belt 842.

(Inserter 900)

The inserter 900 is provided at the upper part of the finisher 500. The inserter 900 inserts an insert sheet at the top page, the last page or some middle page of the sheet P on which an image is formed by the printer portion 300. The inserter 900 feeds the sheet bundle stacked onto insert trays 901, 902 while sequentially separating one sheet by one sheet to the conveying path 520 of the finisher 500 at predetermined timing.

(Controlling Portion of the Copying Machine 1000)

Next, the configuration of the controlling portion of the copying machine 1000 which is the image forming apparatus main body is described with reference to FIG. 6. FIG. 6 is a control block diagram of the copying machine 1000. A CPU circuit portion 150 has a CPU (not illustrated). The CPU circuit portion 150 controls a document feeding controlling portion 101, an image reader controlling portion 201, an image signal controlling portion 202, a printer controlling portion 301 in accordance with a control program which is stored in a ROM 151 and settings of the operating portion 1. The CPU circuit portion 150 also controls a folding process controlling portion 401, a finisher controlling portion 515 and an external I/F 203 in accordance with a control program which is stored in a ROM 151 and settings of the operating portion 1.

The document feeding controlling portion 101 controls the document feeding portion 100. The image reader controlling portion 201 controls the image reader portion 200. The printer controlling portion 301 controls the printer portion 300. The folding process controlling portion 401 controls the folding process portion 400. The finisher controlling portion 515 respectively controls the finisher 500, the saddle stitch binding portion 800 and the inserter 900.

The operating portion 1 includes a plurality of keys for setting various functions regarding the image forming and a display portion for displaying a setting state. The operating portion 1 outputs a key signal which corresponds to each key operation by the user to the CPU circuit portion 150 and displays the corresponding information at the display portion based on the signal from the CPU circuit portion 150.

A RAM 152 is used as an area for temporarily storing control data and as a work area for calculation relating to the control. The external I/F 203 is an interface between the copying machine 1000 and an external computer 204. The external I/F 203 develops print data from the computer 204 into a bit-mapped image and outputs the bit-mapped image to the image signal controlling portion 202 as image data. Further, the image of the document D which is read by an image sensor (not illustrated) is output to the image signal controlling portion 202 from the image reader controlling portion 201. The printer controlling portion 301 outputs the image data from the image signal controlling portion 202 to an exposure controlling portion (not illustrated).

Further, sheet conditions such as a sheet type (plain paper, coated paper or special paper) and a sheet size are input by the use's operation with an operation panel of the image forming apparatus main body. The CPU circuit portion 150 can acquire and recognize the sheet conditions. In addition to the abovementioned sheet size, the sheet conditions include stiffness, thickness, grammage (i.e., basis weight), property values (i.e., surface properties) such as resistance and smoothness, and sheet types such as punch paper and tab paper.

(Controlling Portion of the Finisher 500)

Figure 7:
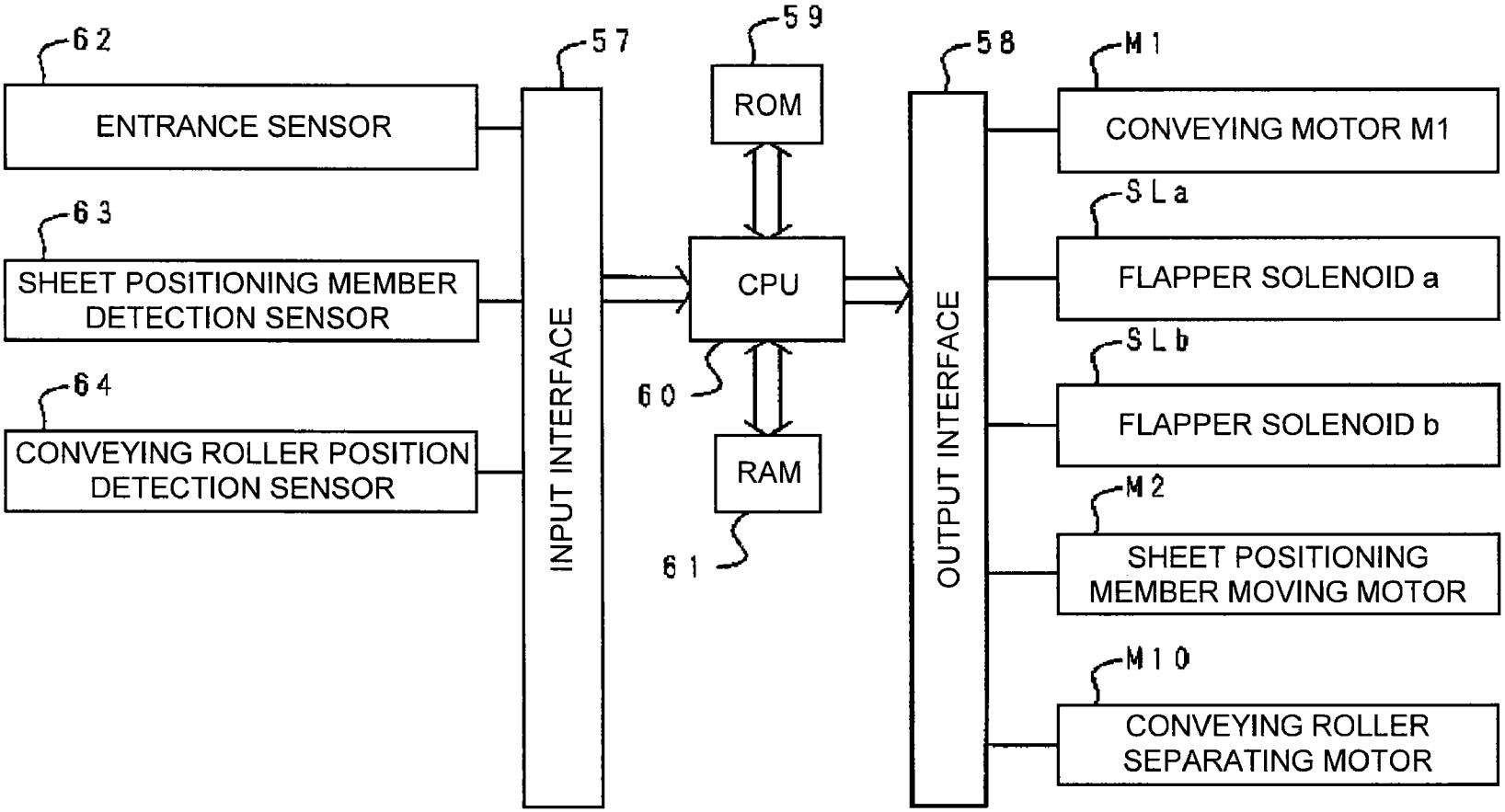
FIG. 7 is a block diagram which illustrates a finisher controlling portion.

The control configuration of the finisher 500 serving as the sheet processing apparatus is described with reference to FIG. 7. FIG. 7 is a functional block diagram which illustrates the configuration of the finisher controlling portion (controlling portion) 515 mounted on the finisher 500. As illustrated in FIG. 7, the finisher controlling portion 515 is configured with a microcomputer system and includes a CPU 60, a ROM 59 and a RAM 61. A program for the punch process and a program for stapling process are previously stored in the ROM 59. The CPU 60 executes each of the programs and generates a predetermined control signal by processing input data while appropriately exchanging data with the RAM 61.

Detection signals from an entrance detection sensor 62, a receiving member detection sensor 63 and a conveying roller position detection sensor 64 are input to the CPU 60 as the input data via an input interface circuit 57. A variety of control signals are output from the CPU 60 via an output interface circuit 58. The output signals are transmitted to control device such as a motor driver and operate the conveying motor M1, the flapper solenoids SLa, SLb, the positioning member moving motor M2 and the conveying roller separating motor M10 by controlling the control device. Further, data communication of sending and receiving is performed between the CPU circuit portion 150 which is provided at the copying machine 1000 side and the CPU 60.

Here, in the description of the present embodiment, the finisher controlling portion 515 which controls the finisher 500 is configured to be arranged at the finisher 500. However, it is also possible to arrange the finisher controlling portion 515 at the image forming apparatus main body side integrally with the CPU circuit portion 150.

(Sheet Conveyance Operation at the Saddle Stitch Binding Portion 800)

Figure 8:
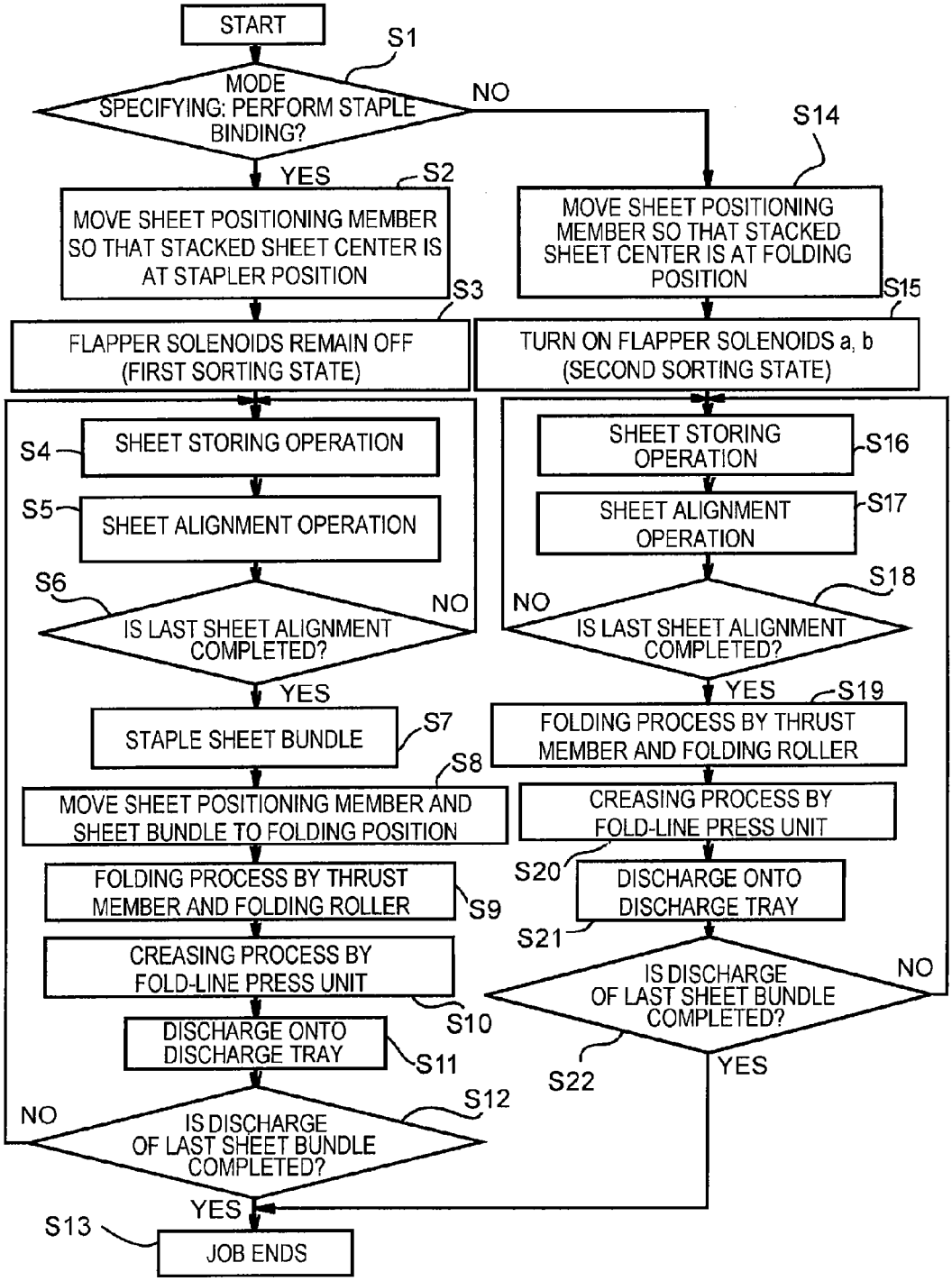
FIG. 8 is a flowchart which describes a control process of the sheet processing apparatus.

Next, the conveyance operation of the sheet at the saddle stitch binding portion 800 is described with reference to FIG. 5 and FIG. 8. FIG. 8 is a flowchart which describes a control process of the sheet processing apparatus.

As described in FIG. 8, when the operation of the saddle stitch binding portion 800 is started, a mode is specified whether or not the staple binding is performed (S1).

In the case that the staple binding is performed (i.e., the saddle stitch binding mode), the positioning member 805 is moved (S2) so that the center of the sheet P is to be the binding position, as illustrated in FIG. 5A. While the flapper solenoids SLa, SLb remain non-powered (S3), the sheet P is inserted (S4) and is aligned (S5). When stacking and aligning of all the sheets are completed (S6), the saddle stitch binding process is performed (S7). Then, the positioning member 805 is moved to the folding position and the sheet bundle is moved to the folding position by the conveying rollers 804 (S8). Then, the folding process is performed by the thrusting member 830 and the pair of folding rollers 810 (S9). Then, the creasing process is performed by the pair of press rollers 861 (S10). The sheet bundle subjected to the creasing process is discharged onto the discharging tray 843 (S11). When discharging of the last sheet bundle is completed (S12), the job ends (S13).

In the case that only folding process is performed without performing the staple binding (i.e., the non-binding folding mode) is specified (S1), the positioning member 805 is moved (S14) so that the center of the sheet P is to be the folding position, as illustrated in FIG. 5B. Both the flapper solenoids SLa, SLb are powered (S15) and the sheet P is inserted (S16). Then, the sheet P is aligned at the folding position (S17) after passing through the binding position without being subjected to the positioning. When stacking and aligning of all the sheets are completed (S18), the folding process is performed by the thrusting member 830 and the pair of folding rollers 810 (S19) at the position where the sheets are directly inserted and aligned. Then, the creasing process is performed by the pair of press rollers 861 (S20). The sheet bundle subjected to the creasing process is discharged onto the discharging tray 843 (S21). When discharging of the last sheet bundle is completed (S22), the job ends (S13).

With abovementioned configuration, at different aligning positions, jams caused by the interference between the trailing end of the stacked sheet P and the top end of the subsequent sheet P which is inserted to the storing guide 803 can be suppressed. Accordingly, the sheet can be conveyed from the pair of saddle entrance rollers 801 directly to the binding position and the folding position. Therefore, folding accuracy and productivity can be improved while suppressing poor conveyance stacking.

Here, with the abovementioned structure, there may be a case that the sheets may not be stacked at the folding position depending on the sheet size to be processed. In this case, the trailing end of the stacked sheet interferes with the top end of subsequent sheet depending on the positions where the first sorting member and the second sorting member (i.e., flappers) are located, namely, the sorting at the trailing end may not be performed. Provided that the positions of the first sorting member and the second sorting member (i.e., flappers) correspond to the sheet size to be processed, the sheets can be sorted so that the trailing end of the stacked sheet bundle is not to be into collision with the top end of the sheet P which is subsequently conveyed. In other words, the top end of the sheet P which is subsequently conveyed only needs to be contacted to the upper surface of the stacked sheet bundle at the downstream in the conveying direction of the trailing end of the sheet bundle which is previously stacked at the folding position.

Figure 9:
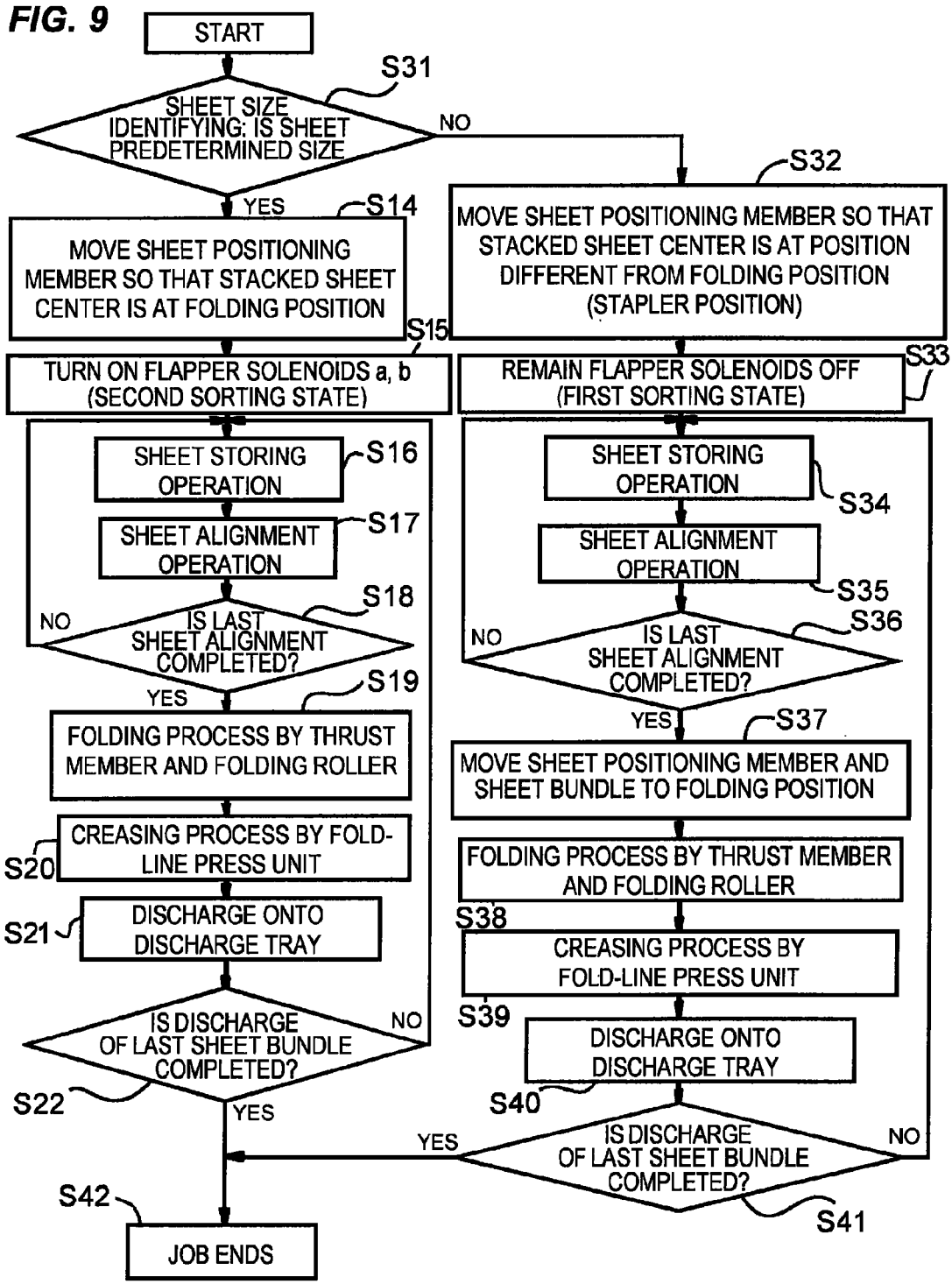
FIG. 9 is a flowchart which describes a control process of the sheet processing apparatus.

In this case, the stack position is controlled to be changed depending on the sheet size, as described in FIG. 9. First, sheet size identifying is performed whether or not the sheet size is a predetermined size (S31).

As described above, in the case that the non-binding folding mode is selected and the sheet size is the predetermined size, the stacking is performed at the folding position and the folding process and the creasing process are performed so that the job ends (S14 to S22 and S42).

In the case that the sheet size is not the predetermined size, for example, in the case of small size sheets (i.e., the trailing end of the stacked sheet interferes with the stapler), the positioning member 805 moves to the binding position as the binding mode (S32). While the flapper solenoids SLa, SLb remain non-powered (S33), the sheet P is inserted (S34) and is aligned (S35). Then, after all the sheets are stacked (S36), the whole sheet bundle is conveyed to the folding position (S37). Then, the folding process and the creasing process are performed and the job ends (S38 to S42).

In the case of a non-standardized sheet size, the positioning member 805 is moved to the position where the trailing end sorting can be performed (i.e., the position being matched to the sorting member, namely, the flapper). The sheets are stacked thereto and the whole sheet bundle is conveyed to the folding position after all the sheets are stacked. In this manner, the sheets of a size other than the predetermined size can be stacked as well.

Here, two units of the stapler (i.e., the first processing unit) 820 and the folding unit (i.e., the second processing unit) are described as examples of the sheet processing unit. However, it is also possible to configure to arrange the punch unit below the stapling unit and to arrange a cut unit below the punch unit. When stapling is performed in this case, the sheets are conveyed and stacked directly to the binding position and each sheet bundle is stapled and discharged. When punching is performed, the sheets are conveyed and stacked directly to a punch position and each sheet bundle is punched and discharged. When cutting is performed, the sheets are conveyed and stacked directly to a cut position and each sheet bundle is cut and discharged. Instead, the apparatus may be configured to discharge the bundle after all the processes are performed.

Second Embodiment

Next, the sheet processing apparatus of the second embodiment according to the present invention is described with reference to the drawings. The same numeral is given to the same part as the above-mentioned first embodiment and the redundant description is omitted.

Figure 12A:
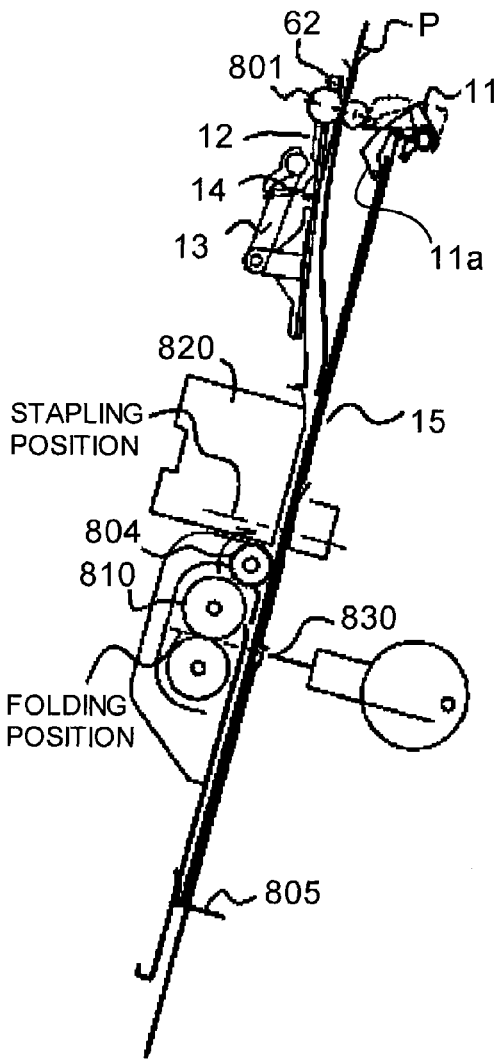
FIG. 12A and FIG. 12B are views which illustrate the sheet conveyance operation.
Figure 12B:
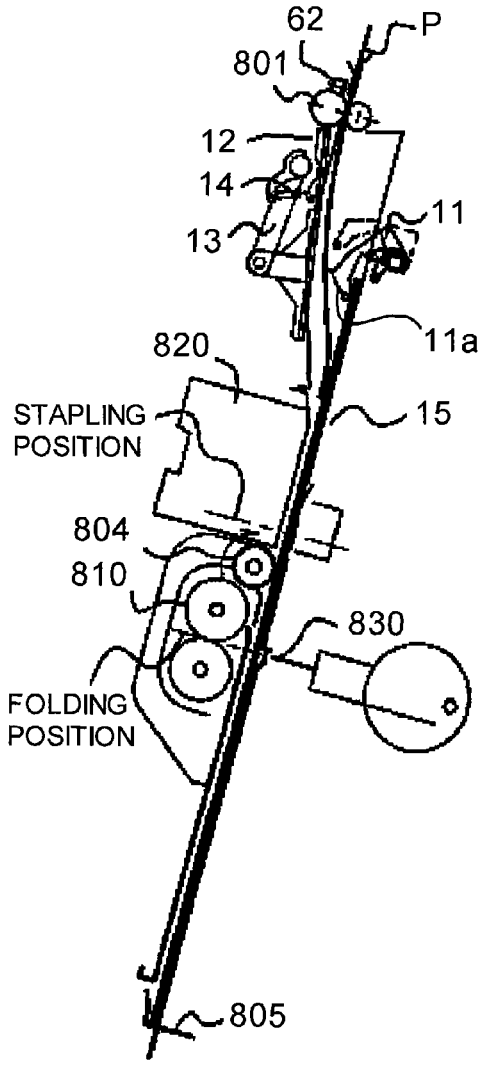

FIG. 12A and FIG. 12B are views which illustrate the sheet conveyance operation. As illustrated in FIG. 12A and FIG. 12B, a holding member (i.e., a sorting member) 11 is provided in the sheet processing apparatus of the second embodiment. The holding member 11 is arranged above the storing guide 803 which is configured to be vertical (75° against the horizontal surface in the drawings) and holds the trailing end part (i.e., the upstream end part) in the discharge direction of the sheet P stacked at the storing guide 803. In the description of the present embodiment, the holding member 11 is configured to hold the upstream end of the sheet in the conveying direction. However, it is also possible to configure the holding member 11 to hold the downstream end of the sheet in the conveying direction depending on the direction of the sheet conveying to the storing guide 803. In other words, the present invention is applicable in the configuration that the positioning member 805 receives one end of the sheet in the conveying direction and the holding member 11 holds the other end of the sheet in the conveying direction.

Figure 10:
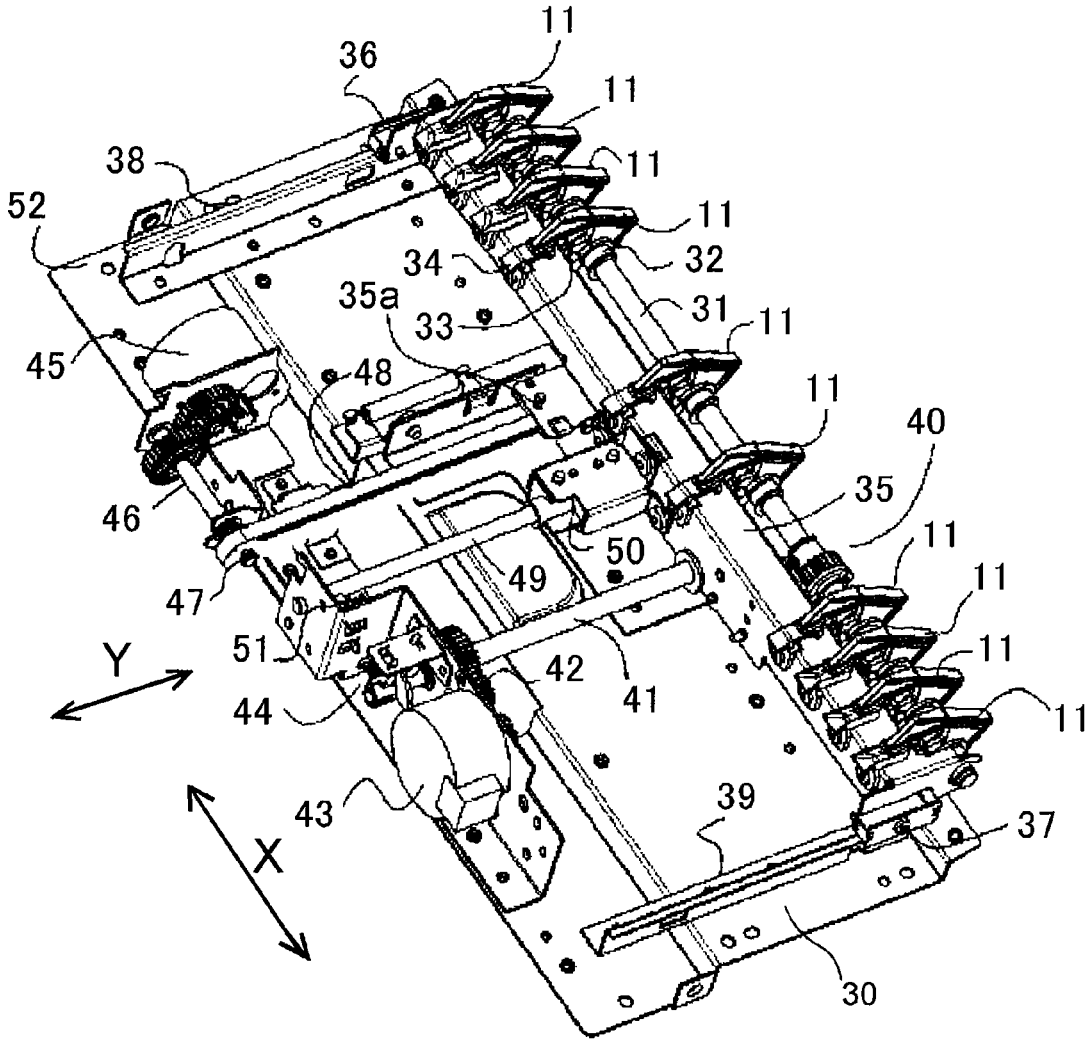
FIG. 10 is a perspective view which illustrates the configuration of a vicinity of a holding member.

FIG. 10 is a perspective view which illustrates the configuration of a vicinity of the holding member 11. As illustrated in FIG. 10, a supporting member 35 is movably attached to a frame 30. A holding shaft 31 serving as a part of a first holding member is rotatably supported by the supporting member 35. The holding member 11 is fixedly provided to the holding shaft 31.

A holding member rotating motor 43 is a motor which rotates the holding member 11 and the holding shaft 31. The holding member rotating motor 43 applies driving force to a drive gear portion 42 and drives a drive shaft 41 to rotate. The drive shaft 41 transmits the driving force to the holding shaft 31 via a drive portion 40 which is arranged at the supporting member 35 and drives the holding shaft 31 to rotate. The sorting portion of the present embodiment is configured with the holding member 11, the holding shaft 31, the drive portion 40, the drive shaft 41, the drive gear portion 42 and the holding member rotating motor 43.

A holding member position detection sensor 44 serving as a sensor portion detects the rotating position of the holding member 11 by detecting the rotating angle of the drive shaft 41. The position of the holding member 11 which is rotated by the holding member rotating motor 43 is controlled based on the detection result.

With the abovementioned configuration, the holding member 11 is capable of being moved to a sheet holding position (i.e., the solid-line position in FIG. 12A and FIG. 12B) and a sheet retracting position (i.e., the dotted-line position in FIG. 12A and FIG. 12B).

The supporting member 35 is supported to a moving shaft 49 being free to slide via a slide bush 50 which is fixedly provided at the supporting member 35. Slide rails 38, 39 are fixed at both end sides of the frame 30 in X-axis direction. Slide bushes 36, 37 which are fixedly provided to the supporting member 35 are attached on the slide rails 38, 39 being free to slide.

Further, a timing belt 48 is attached at an approximate middle part of the frame 30. The longitudinal direction of the timing belt 48 is along Y-axis direction. A holding member moving motor 45 transmits driving force to the timing belt 48 via a drive portion 46. A supporting member position detection sensor 51 serving as the sensor portion detects the position of the supporting member 35. The position in Y-axis direction of the supporting member 35 which is moved by the holding member moving motor 45 is controlled based on the detection result.

With such the configuration, the holding member 11 is movable in the conveying direction of the sheet P to be at the positions in FIG. 12A and FIG. 12B.

Further, as illustrated in FIG. 12B, a sheet-passing guide surface 11*a* which is obtuse-angled (i.e., about 150°) to the surface of the stack tray 15 is formed at the holding member 11. Accordingly, even in the case that the top end of the sheet P is passing the holding member 11, the sheet P can be conveyed over the holding member 11 without causing a jam.

The abovementioned configuration is different from the sorting member of the first embodiment which works only for the predetermined sheet size. In other words, the sheets can be sorted so that the trailing end of the stacked sheet bundle is not to be into collision with the top end of the sheet P which is subsequently conveyed while holding the trailing end (i.e., the upper end) of the stacked sheet bundle even in the case that the size of the sheets to be stacked is uneven.

Here, for the sheet sorting, it may be considered that the pair of saddle entrance rollers 801 is configured to move in the conveying direction in accordance with the sheet size. However, by simply arranging the angle of the sheet-passing guide surface 11*a* as described above, it is not needed that the pair of saddle entrance rollers 801 is configured to move in the conveying direction in accordance with the sheet size. Therefore, the apparatus can be compact.

Figure 11:
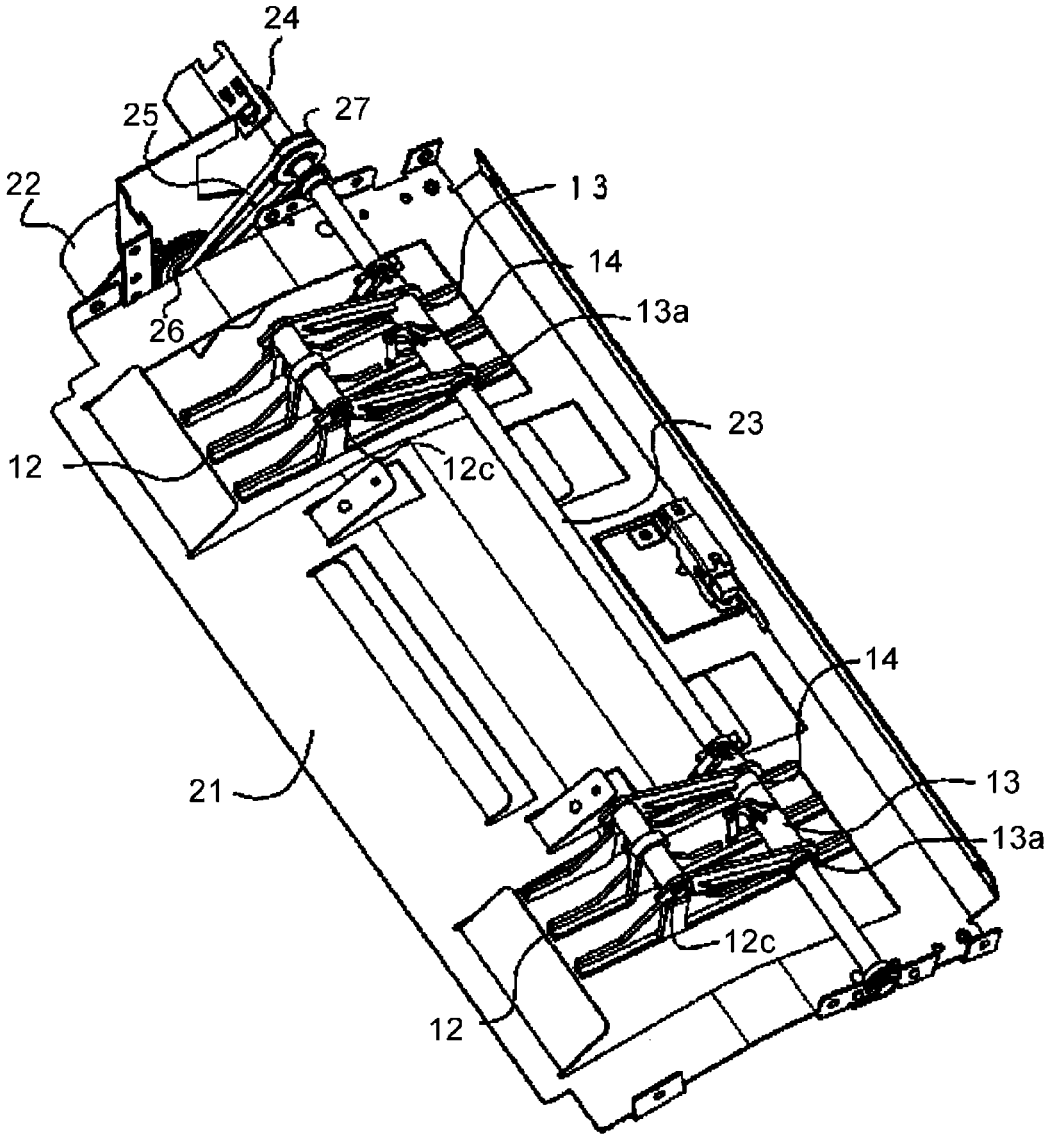
FIG. 11 is a perspective view which illustrates the configuration of a tapping member.

Next, a tapping member 12 is described. FIG. 11 illustrates the configuration of the saddle stitch binding portion 800, and in particular, is a perspective view which illustrates the configuration of a vicinity of the tapping member 12.

As illustrated in FIG. 11, FIG. 12A and FIG. 12B, the tapping member 12 which is arranged in plural manner in the direction perpendicular to the conveying direction is rotatably supported by a tap holding member 13 having a pivot 12*c* as the rotation center. Further, the tapping member 12 is urged in the direction so that the upstream side of the conveying direction is to be apart from the sheet-passing surface by a spring 14 of which one end is supported by the tap holding member 13. Then, the tapping member 12 is engaged with a stopper portion 13*a* in a normal state. The tap holding member 13 is fixed to a rotation shaft 23. A holding member rotating motor 22 transmits driving force to the rotation shaft 23 via drive transmitting portions 25, 27 so that the tapping member 12 is capable of being rotated. A detection unit 24 detects the position of the tapping member 12. The position of the tapping member 12 is controlled based on the detection result.

Figure 13A:
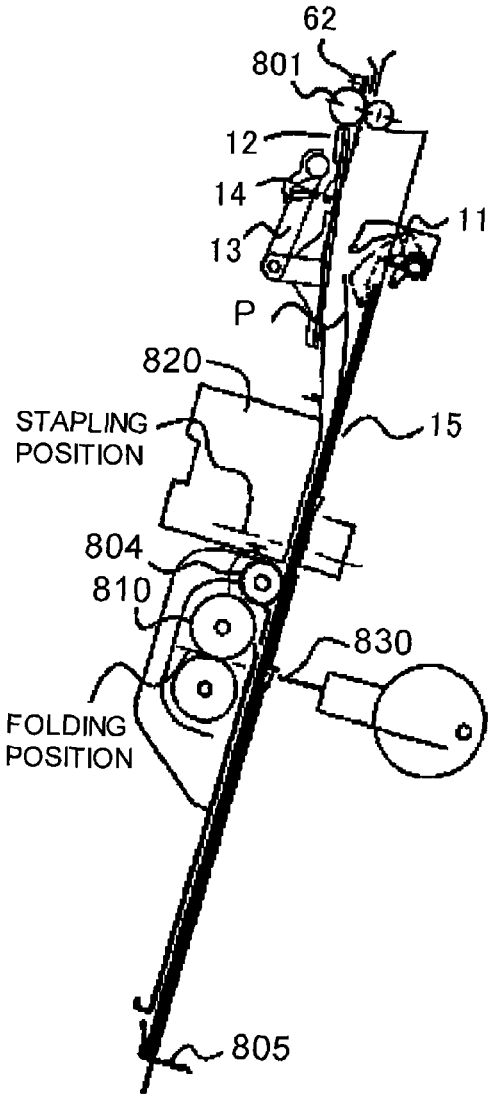
FIG. 13A and FIG. 13B are views which illustrate the holding member, the tapping member and the sheet conveyance operation.
Figure 13B:
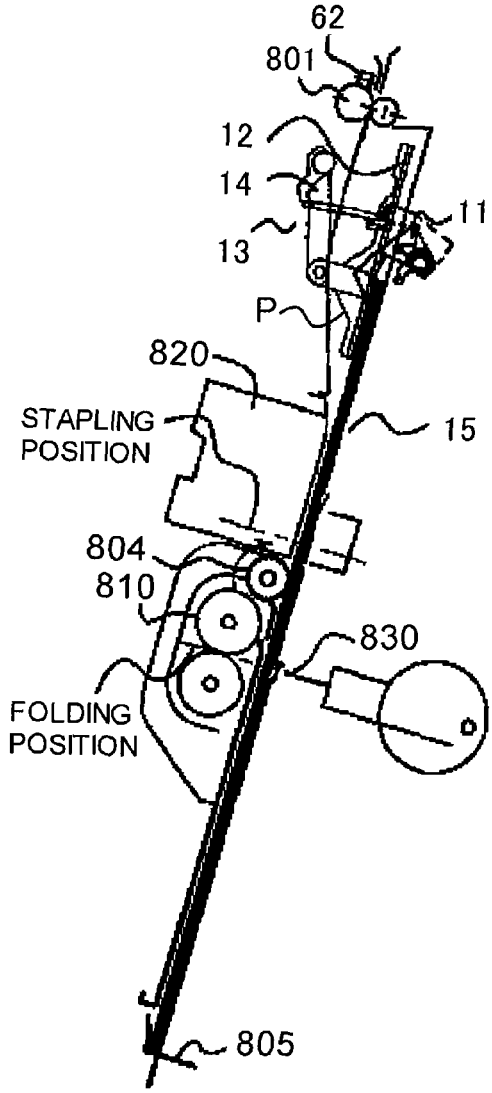

FIG. 13A and FIG. 13B are views which illustrate the holding member 11, the tapping member 12 and the sheet conveyance operation. FIG. 13A illustrates a state that the holding member 11 is retracted at the solid-line position after the sheet P stacked onto the stack tray 15 of the storing guide 803 is conveyed and aligned by an aligning plate. FIG. 13B illustrates a state that the holding member 11 holds the trailing end of the sheet bundle while the tapping member 12 presses the sheet along the stack tray 15 after the tap holding member 13 and the tapping member 12 are rotated.

In this manner, the tapping member 12 and the holding member 11 sort the trailing end of the stacked sheet and the top end of the subsequent sheet by being operated for each sheet which is to be stacked.

FIG. 12A illustrates a state that the saddle stitch binding mode is specified and FIG. 12B illustrates a state that the non-binding folding mode is specified. In each of the cases, by locating the positioning member 805 and the holding member 11 at the predetermined positions, the sheet can be conveyed directly to the binding position and the folding position, as similar to the first embodiment.

In the present embodiment, the holding member 11 which is movable in accordance with the sheet length is arranged along the stack tray 15. Therefore, the subsequent sheet can be inserted in the state that the trailing end (i.e., the upper end) of the stacked sheet bundle is held even when the sheet to be stacked is a non-standardized size. Consequently, the sheet can be conveyed from the pair of saddle entrance rollers 801 directly to the binding position and the folding position without a jam caused by the interference between the trailing end of the stacked sheet and the top end of the subsequent sheet to be inserted to the storing guide 803.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-181251, filed Jul. 11, 2008, and No. 2009-152305, filed Jun. 26, 2009, which are hereby incorporated by reference herein in their entirety.

What is claimed is:

1. A sheet processing apparatus comprising:

a conveying portion which conveys a sheet in a conveying direction;

a stacking portion on which the sheet conveyed by the conveying portion is stacked;

a first processing unit which performs a first process to the sheet at a first process position on the stacking portion;

a second processing unit which performs a second process to the sheet at a second process position on the stacking portion, the second process position being at the downstream side in the conveying direction of the first process position;

a receiving member which is movable in the conveying direction of the sheet so as to perform positioning of the sheet in the conveying direction by receiving one end in the conveying direction of the sheet conveyed to the stacking portion;

a controlling portion which controls the driving unit so that the receiving member is moved in the conveying direction so as to perform positioning of the sheet at the first process position to perform the first process and then positioning of the sheet at the second process position to perform the second process in a case that the second processing unit performs the second process after the first processing unit performs the first process to the sheet, and so as to perform positioning of the sheet at the second process position in a case that the second processing unit performs the second process to the sheet passed through the first process position without being positioned at the first process position to perform the first process.

2. The sheet processing apparatus according to claim 1, further comprising:

a sorting member which performs sorting to prevent collision between the downstream end in the conveying direction of the sheet conveyed to the stacking portion by the conveying portion and the upstream end in the conveying direction of the sheet stacked at the first process position or the second process position, wherein the controlling portion controls the sorting member in accordance with the process to be performed to the sheet.

3. The sheet processing apparatus according to claim 2, wherein the sorting member is a holding member which is movable in the conveying direction of the sheet so as to hold another end opposed to the one end, in the conveying direction of the sheet stacked at the stacking portion, and the controlling portion moves the holding member in accordance with the process to be performed to the sheet.

4. The sheet processing apparatus according to claim 2, wherein the sorting member is a movable guiding member to switch a guide path which guides the conveyed sheet to the stacking portion, and the controlling portion switches the guide path by moving the guiding member in accordance with the process to be performed to the sheet.

5. The sheet processing apparatus according to claim 1, wherein the controlling portion further performs the first process at the first process position without performing the second process at the second processing unit.

6. The sheet processing apparatus according to claim 1, wherein the controlling portion performs positioning by conveying the sheet directly to the first process position or the second process position selectively in accordance with the length in the conveying direction of the sheet which is to be stacked at the stacking portion.

7. The sheet processing apparatus according to claim 1, wherein the first processing unit is a binding unit and the second processing unit is a folding unit.

8. An image forming apparatus comprising:

an image forming portion which forms an image on a sheet; and a sheet processing apparatus according to claim 1 which processes the sheet on which the image is formed.

9. An image forming apparatus comprising:

an image forming portion which forms an image on a sheet;

a sheet processing apparatus which processes the sheet on which the image is formed; and a controlling portion which controls the sheet processing apparatus, wherein the sheet processing apparatus includes a conveying portion which conveys the sheet in a conveying direction, a stacking portion which stacks the sheet conveyed by the conveying portion, a first processing unit which performs a first process to the sheet at a first process position on the stacking portion, a receiving member which is movable in the conveying direction of the sheet so as to perform positioning of the sheet in the conveying direction by receiving one end in the conveying direction of the sheet conveyed to the stacking portion;

a second processing unit which performs a second process to the sheet at a second process position on the stacking portion, the second process position being at the downstream side in the conveying direction of the first process position, the controlling portion controls the driving unit so that the receiving member is moved in the conveying direction so as to perform positioning of the sheet at the first process position to perform the first process and then positioning of the sheet at the second process position to perform the second process in a case that the second processing unit performs the second process after the first processing unit performs the first process to the sheet, and so as to perform positioning of the sheet at the second process position in a case that the second processing unit performs the second process to the sheet passed through the first process position without being positioned at the first process position to perform the first process.

10. The image forming apparatus according to claim 9, wherein the sheet processing apparatus further includes a sorting member which performs sorting to prevent collision between the downstream end in the conveying direction of the sheet conveyed to the stacking portion by the conveying portion and the upstream end in the conveying direction of the sheet stacked at the first process position or the second process position, and the controlling portion controls the sorting member in accordance with the process to be performed to the sheet.

11. The image forming apparatus according to claim 10, wherein the sorting member is a holding member which is movable in the conveying direction of the sheet so as to hold another end, opposed to the one end, in the conveying direction of the sheet stacked at the stacking portion, and the controlling portion moves the holding member in accordance with the process to be performed to the sheet.

12. The image forming apparatus according to claim 10, wherein the sorting member is a movable guiding member to switch a guide path which guides the conveyed sheet to the stacking portion, and the controlling portion switches the guide path by moving the guiding member in accordance with the process to be performed to the sheet.

13. The image forming apparatus according to claim 9, wherein the controlling portion further performs the first process at the first process position without performing the second process at the second processing unit.

* * * * *